United States Patent [19]

Davis

[11] Patent Number: 4,784,252

[45] Date of Patent: Nov. 15, 1988

[54] DOUBLE DOOR FRONT LOCKING NEWSPAPER VENDING MACHINE

[76] Inventor: Wallace E. Davis, 2318 Royal Oaks Dr., Alamo, Calif. 94507

[21] Appl. No.: 20,351

[22] Filed: Mar. 2, 1987

[51] Int. Cl.[4] ..... G07F 9/10; G07F 11/02

[52] U.S. Cl. ..... 194/350; 194/248; 221/154; 292/302; 49/394; 70/134

[58] Field of Search ..... 194/247, 350, 353, 248, 194/290, 233; 292/302, 150, 163, 175, 2; 70/34, 134; 312/138 R, 292, 35; 221/154, 155, 241; 49/35, 163, 169, 170, 394, 395

[56] References Cited

U.S. PATENT DOCUMENTS

| | | | |
|---|---|---|---|
| 1,967,627 | 7/1934 | Riley et al. | 292/302 |
| 2,150,064 | 3/1939 | John et al. | 312/292 X |
| 3,550,411 | 12/1970 | Neary et al. | 70/452 X |
| 4,133,142 | 1/1979 | Dzus, Jr. | 49/394 X |
| 4,269,048 | 5/1981 | McDorman | 70/34 X |
| 4,544,081 | 10/1985 | Voegeli | 194/350 X |

FOREIGN PATENT DOCUMENTS

| | | | |
|---|---|---|---|
| 2425386 | 12/1975 | Fed. Rep. of Germany | 70/34 |
| 313984 | 1/1934 | Italy | 292/302 |

*Primary Examiner*—Joseph J. Rolla
*Assistant Examiner*—Edward S. Ammeen
*Attorney, Agent, or Firm*—Alvin E. Hendricson

[57] ABSTRACT

An enclosed newspaper vending machine has a double front door with a paper access door mounted in a security door carrying coin actuated release mechanism for the paper access door and a key operated pin lock fits within a surrounding guard on the front of the security door for locking engagement with a rod or pin extending forwardly from an interior wall of the enclosure.

5 Claims, 1 Drawing Sheet

DOUBLE DOOR FRONT LOCKING NEWSPAPER VENDING MACHINE

BACKGROUND OF INVENTION

Newspaper vending machines employed as coin actuated dispeners of newspapers are formed as rectangular metal boxes having a pivotally mounted front door with coin actuated release or latching mechanism within the box and coin slots for inserting coins to release the door and gain access to papers piled within the box. These types of newspaper dispensers have become quite standard and are used daily by millions of people.

Unfortunately, newspaper vending machines that may be located in exposed locations such as street corners, and the like, are subject to theft of the coins therein. The coin actuated release mechanism and coin box are separated by one or more walls from the newspaper receptacle to prevent pilferage and removable coin boxes have been locked, as by cabinet locks or padlocks to prevent unauthorized access thereto. Such precautions have led to physical assaults upon the dispensers with a variety of tools such as pry bars or crowbars to pry open doors and drawers as well as mauls and punches to disable cabinet locks and smash hasps, staples and the like. Almost any slit or apetured protuberance has been subject to destructive attack resulting in major damage to the racks as well as loss of coins therein.

In an effort to thwart rip off artist or thieves, there has been developed dispensers or vending machine having internal locks to prevent easy access to the coin box. In this type of machine the actuating mechanism and coin box are entirely enclosed in a separate internal compartment of an enclosure, box, or rack for engagement with a padlock or cabinet lock, for example, inside the enclosure. In this manner neither the padlock shackle nor anything such as staples or links engaged thereby are exteriorly located and are thus not vulnerable to prying, twisting or leveraging. However, newspaper distributers or the like must manipulate a key into a lock in a relatively inaccessible location i.e. within the enclosure behind the wall in order to gain access to the coinbox. While this operation can certainly be performed, it is time consuming and unhandy. When it is considered that an official coin collector may have to service a very large number of newspaper vending machines,the expenditure of more than one minute each merely for access and relocking unduly extends the time required to complete a route.

SUMMARY OF INVENTION

The present invention provides a highly secure and readily and rapidly serviced double door newspaper vending machiine of the type having coin actuated paper access. The machine hereof has a pivotally mounted security door that may carry a coin actuated latch mechanism and which mounts a paper access door which is normally provided with a window for viewing of the newspaper being dispensed. Coin slots in the security door receive coins for operating the latch mechanism to release the paper access door so that it may be moved to open the interior newspaper compartment of the enclosure.

The double door rack hereof has a front locking arrangement for the security door to provide easy and rapid access to the coin actuated latch mechanism and a coin box disposed within the enclosure. Within the enclosure rigid walls separate a newspaper receptacle from a compartment about the latch mechanism and containing a coin box receiving coins from this mechanism. A pin or rod rigidly extends forwardly within this compartment for extension through an opening in the security door into engagement with a pin lock disposed within a surrounding guard or shield fixed to the front of the security door. Key operation of the pin lock releases it from the interior fixed rod to allow the security door to be pivoted open. Substantially complete protection from forceable entry to the coin box is provided by readily accessible means requiring no blind manipulation or access to the interior of the rack enclosure.

BRIEF DESCRIPTION OF DRAWINGS

The present invention is illustrated with respect to a preferred embodiment thereof in the accompanying drawings; wherein.

DESCRIPTION OF PREFERRED EMBODIMENT

Figure 1:
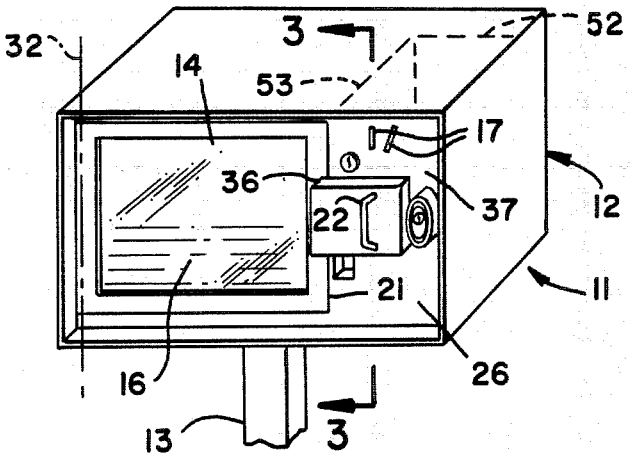
FIG. 1 is a front perspective view of a newspaper vending machine in accordance with the present invention.
Figure 3:
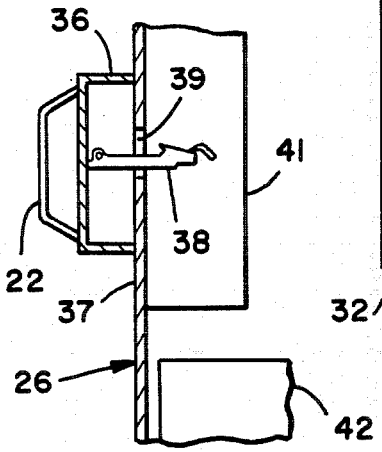
FIG. 3 is a partial sectional view taken in the plane 3—3 of FIG. 1.

Referring now to the drawings, there will be seen to be shown a newspaper vending machine formed as a rectangular enclosure 12 that may, for example, be mounted upon a stand 13 and normally having a front window 14 for displaying one of the newspapers 16 adapted to be sold from the machine. The vending machine or rack 11 is adapted to contain a stack of newspapers within the enclosure 12. Coin slots 17 in the front of the machine are provided to receive coins for releasing a paper access door 21 having a handle 22 thereon for pivoting the door outwardly for access to newspapers with the enclosure.

The vending machine 11 is provided with a double front door system wherein the access door 21 is mounted in a security door 26 that is pivotably mounted in closing relationship to an open front of the enclosure 12. Preferably the security door is inset from the front edges of the enclosure 12 which protrude forwardly of the door, as indicated at 31 of FIG. 4. As illustrated, the security door and access door are both pivotably mounted about a common vertical axis 32 at the left of the enclosure 12 with the access door then being pivotably mounted within the security door 26. The security door entirely closes the front opening of the enclosure 12 to tightly fit therein in recessed relationship to the edges of the enclosure and the access door 21 fits within the opening of the security door in very close relationship to the edges of such opening and has an extension 36 which overlies a solid right hand portion 37 of the security door. A latch 38 mounted on the inner side of this extension 36 of the access door extends through an opening 39 in the solid portion 37 of the security door into a coin release mechanism 41 carried on the inner side of the security door. The coin slots 17 in the security door lead into this coin release mechanism 41 for releasing the latch therein so that the access door 21 may be pivoted about the axis 32 upon release of the latch pin or catch so that a customer may remove a newspaper from the machine 11. The coin release mechanism 41 may be conventional and is thus not further described herein. Beneath the coin release mechanism 41 there is provided a coin box 42 within the enclosure for receiving coins inserted in the coin slot 17 and passing through the coin mechanism 41. A coin return slot 43 is also provied for return of unacceptable coins. There may also be provided a cabinet lock or like 44 on the front 37 of the security door 26 for switching the coin mechanism 41 to operate on a different value of coins for Sunday papers.

It will be appreciated that the vending machine 11 must be periodically serviced to replace newspapers therien and to remove coins from the coin box 42. It is also necessary to secure the enclosure 12 so that no unauthorized entry thereto may be accomplished to endanger the coin release mechanism or allow theft of coins contained in the coin box. The foregoing is normally accomplished by locking the front door of the enclosure 12 and the present invention provides a marked improvement in such locking for utmost security and ease of access by authorized personnel.

Figure 2:
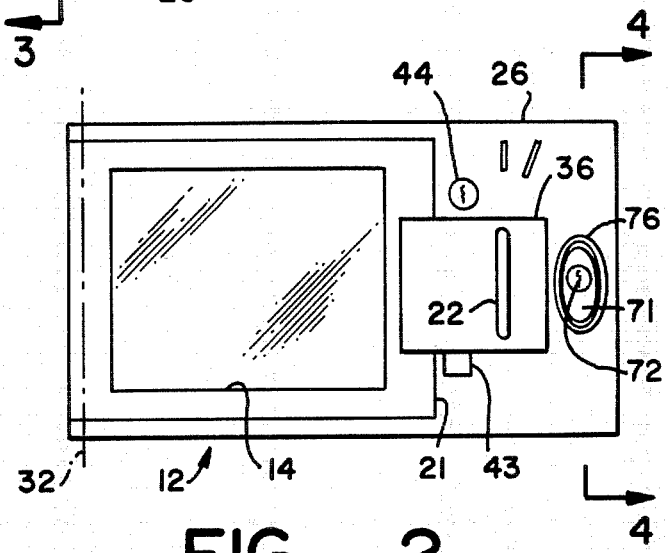
FIG. 2 is a front elevational view of the doors of the machine of FIG. 1.
Figure 4:
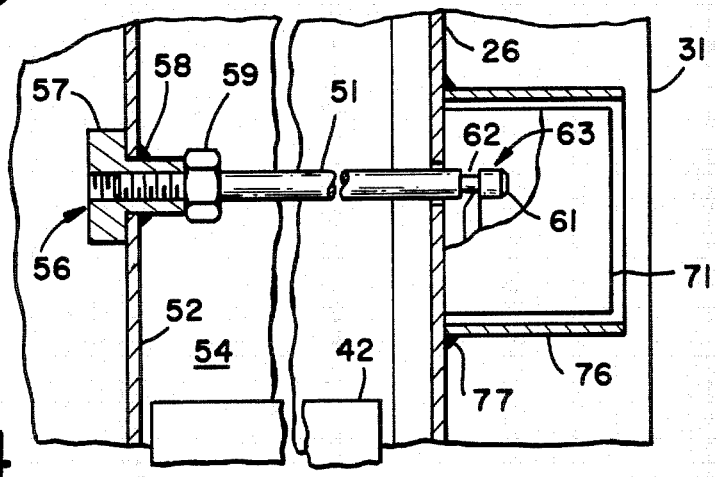
FIG. 4 is a partial sectional view taken in the plane 4—4 of FIG. 2.

Referring now to FIGS. 2 and 4 there will be seen to be shown a front lock system for securing the security door 26 in closed position. This system includes a rigid pin or rod 51 mounted on an internal wall 52 extending from a side wall of the box or enclosure 12 to a transverse wall 53 and together defining a compartment 54 within which the coin release mechanism 41 and coin box 42 are disposed. This compartment 54 is separated from the main newspaper compartment of the enclosure which extends in back of the compartment 54 so that the wall 52 is entirely inside of the enclosure 12. The pin or rod 51 is secured to the wall 52 by threading the inner end of the rod into a longitudinally threaded cylinder 56 extending through an opening in the wall 52 and having a flange 57 about one end thereof contacting the back side of the wall 52. The cylinder 56 is welded to the wall 52 as indicated at 58 of FIG. 4. A lock nut 59 is threaded on the inner end of the rod 51 for tightening against the cylinder 57 to fix the longitudinal extension of the rod from the cylinder.

The pin or rod 51 extends through the compartment 54 and through a small opening in the security door 26. Further to the configuration of the pin or rod 51, it is noted that same is formed of iron or steel in the shape of an elongated cylinder with the inner end threaded and the outer end having a rounded or tapered shape as shown at 61. A circumferential slot 62 extends about the rod behind the tapered end 61 to thus form a heat 63 which is adapted to extend a predetermined distance through the security door 26 when the latter is closed.

Locking of the security door in closed position across the front of the enclosure 12 is accomplished by means of a "pin lock" 71, which is a commercially available item having the form of a padlock without the shackle or U-shaped arm but including an end opening with key operated mechanism for locking onto a pin or rod inserted in the opening. The term "pin lock" is herein employed to denote a padlock mechanism and housing without a U-shaped arm but instead having at least one end opening for insertion of one or more pins that are grasped and locked by the locking mechanism until released by a key or combination arrangement. This lock 71 is adapted to be pressed onto the head end 63 of the rod 51 on the outside of the security door 26 to grip the rod and lock the door in closed position. The engagement of lock and rod is schematically illustrated in FIG. 4. In order to prevent access to the lock 71 by vandals or thieves who might otherwise twist or pry same to gain entry to the enclosure, there is herein provided a shield or guard 76 in the shape of a hollow rigid cylinder formed of iron or the like and welded at 77 to the front face of the door 26 about the protruding end of the rod 51. This shield 76 may have an oval cross section to receive the lock 71 in snug relation therein and extends beyond the lock so that only a key slot 72 in the outer end of the lock is accessible from the outside of the vending machine. This rigid shield about the lock precludes bending, twisting or prying of the lock from the door 26 and thus maximizes security of the enclosure 12 and particularly the compartment 54 therein. It is further noted in this respect that the inner threaded end of the rod 51 and the means mounting the rod on the wall 52 is disposed within the enclosure 12 so as to be fully protected and unavailable for tampering.

The present invention, as described above, will be seen to provide a truly secure enclosure that is readily opened by one having a key to the exterior lock. Both doors and the lock are formed and protected so that they are substantially impervious to prying, twisting or other attack by unauthorized persons that may attempt to open the machine. Additionally, the location of the lock on the front of the machine materially simplifies opening of same by service or replacement personel having a key to the lock. This then provides quick and easy access to the coin box for coin removal and to the coin release mechanism for repair or adjustment by authorized personel.

The present invention has been described above with respect to a single preferred embodiment, however, it will be apparent to those skilled in the art that modification and variations may be made within the spririt and scope of the present invention and thus it is not intended to limit the invention by the precise terms of description or details of illustration.

What is claimed is:

1. A newspaper vending machine comprising means defining an enclosure having an open front, a security door having a rod opening and an opening therein and pivotally mounted in closing relation to the open front of said enclosure and mounting a coin release mechanism on an inner surface thereof, an access door pivotally mounted in closing relation to the opening in said security door and having latch means adapted to cooperate with said coin release mechanism, a rigid locking rod mounted within said enclosure and extending forewardly therein through said rod opening in said security door, a rigid hollow cylindrical shield fixed to a front surface of said security door exteriorly of said enclosure about said rod opening, and a key operated pin lock fitted entirely within said shield for latching engagement with said locking rod to lock said security door in closing relation to said enclosure for release only by key operation of said pin lock.

2. The vending machine of claim 1 further defined by internal fixed walls within said enclosure defining a separate compartment open to the coin release mechanism on said security door and adapted to contain a coin box, said locking rod being mounted upon one of said internal fixed walls and disposed across said separate compartment for extension through the rod opening in said security door.

3. A newspaper vending machine comprising means defining an enclosure having an open front, a security door having a rod opening and an opening therein and pivotally mounted in closing relation to the open front of said enclosure and mounting a coin release mechanism on an inner surface thereof, an access door pivotally mounted in closing relation to the opening in said security door and having latch means adapted to cooperate with said coin release mechanism, internal fixed walls within said enclosure including a wall that is substantially parallel to the front of said enclosure and defining a separate compartment open to the coin release mechanism on said security door and adapted to contain a coin box, a rigid locking rod mounted within said enclosure and extending forwardly therein through said rod opening in said security door, said locking rod being mounted upon said internal fixed wall that is disposed parallel to the front of said enclosure by threaded engagement with a cylinder having a threaded bore and welded to said internal wall, a rigid hollow cylindrical shield fixed to a front surface of said security door exteriorly of said enclosure about said rod opening, and a key operated pin lock fitted entirely within said shield for latching engagement with said locking rod to lock said security door in closing relation to said enclosure for release only by key operation of said pin lock.

4. The newspaper vending machine of claim 3 further defined by said cylinder having an exteriorly flanged end disposed on the far side of said parallel internal wall from the open front of said enclosure with the cylinder extending through a mating opening in said wall, and a lock nut threaded on said locking rod against said cylinder for adjustably fixing the extension of said rod from said internal wall.

5. The newspaper vending machine of claim 3 further defined by said locking rod having a tapered outer end away from said tapered end for defining a rod head adapted to extend into said pin lock for latching engagement therewith.

* * * * *